US005115617A

United States Patent [19]

Lewis et al.

[11] Patent Number: 5,115,617

[45] Date of Patent: May 26, 1992

[54] CAPPING MACHINE

[75] Inventors: Graham Lewis, Baie d'Urfé ; Milos Prchal, Chomedey-Laval; Siegfried H. Weidner, Brossard; Max Yablonovitch, Dollard des Ormeaux, all of Canada

[73] Assignee. H. G. Kalish Inc., Pointe-Claire, Canada

[21] Appl. No.: 626,543

[22] Filed: Dec. 12, 1990

[51] Int. Cl.[5] ..... B65B 7/28

[52] U.S. Cl. ..... 53/306; 53/317

[58] Field of Search ..... 53/306, 308, 311, 312, 53/317, 328, 331.5, 342, 345, 357, 302, 301, 304, 314; 221/239, 268, 270, 294, 307

[56] References Cited

U.S. PATENT DOCUMENTS

| | | | |
|---|---|---|---|
| 944,548 | 12/1909 | Freyer | 53/306 |
| 981,817 | 1/1911 | Thelen | 53/342 |
| 1,169,775 | 2/1916 | Cornwall . | |
| 1,375,364 | 4/1921 | Clark | 53/311 |
| 2,729,377 | 1/1956 | O'Neil | 53/306 |
| 2,737,330 | 3/1956 | Halahan et al. | 53/306 |
| 2,797,541 | 7/1957 | Cookson | 53/306 |
| 2,826,885 | 3/1958 | Henderson et al. | 53/306 |
| 4,222,214 | 9/1980 | Schultz et al. . | |
| 4,535,583 | 8/1985 | Tanaka et al. | 53/317 X |
| 4,663,913 | 5/1987 | Trendel | 53/331.5 X |
| 4,756,137 | 7/1988 | Lanigan | 53/306 X |

*Primary Examiner*—Robert L. Spruill
*Assistant Examiner*—Daniel B. Moon
*Attorney, Agent, or Firm*—Shlesinger, Arkwright & Garvey

[57] ABSTRACT

An apparatus to cap in succession containers transported in serial order on a conveyor belt. The apparatus comprises a cap dispensing station operating in a timed-relationship with the container feed rate to loosely apply on each container a screw-type cap in thread alignment with the threads on the container neck. The cap dispensing station includes a cap relase passage at least partially closed by a resilient lip preventing a cap to travel through the passage under the effect of gravity. A selectively actuatable cap ejector drives the cap out of the passage against the resiliency of the lip, freeing the cap which is deposited on a container underneath. During the cap movement through the passage, the resilient lip frictionally engages the cap, guiding same, to allow precise positioning of the cap on the container. A cap tightening station is provided downstream of the cap dispensing station to rotatably engage the caps loosely applied to the containers to tighten same.

17 Claims, 5 Drawing Sheets

CAPPING MACHINE

FIELD OF THE INVENTION

The present invention relates to an apparatus for sealing containers with screw-type caps and, more particularly, it is directed toward a novel capping machine with provisions to accurately deport a cap on a container to achieve a thread alignment condition between the cap and the threaded container neck to permit a reduction in failure rates at the cap tightening stage.

BACKGROUND OF THE INVENTION

In the bottling industry, reclosable containers are usually sealed with screw-type caps. To achieve a high productivity, the container sealing operation is performed by automatic capping machines processing in succession the containers transported in serial order on a conveyor belt or on any other type of materials handling machine. In typical capping machines, the container sealing operation is a two-step process. Firstly, the open container passes underneath a cap dispensing station applying loosely on the container neck a screw-type cap in thread alignment with the threads on the container neck (for the purpose of this specification, the term "thread alignment" designates a condition where the cap is not threadedly engaged on the container neck, however the threads on the cap and on the neck respectively are so disposed that rotation of the cap will cause the threads to mate in the correct fashion resulting in thread engagement. In contrast, "thread misalignment" will be used to identify a condition where rotation of the cap will cause improper thread engagement resulting in a poorly sealed container). The container is then transported to a cap tightening station where a chuck rotatably grips the cap, tightening same and sealing the container.

The accurate positioning of the cap on the container neck is a critical operation to ensure a proper thread engagement during the cap tightening stage. With currently available equipment, the method which is used to deposit the caps on the containers at the cap dispensing station is extremely simple. The caps are fed from a supply chamber or magazine to a cap dropping aperture where a latch drops the caps on the containers in a timed relationship with the container feed rate. Although a cap is dropped only a very short distance from the top of a container neck, during its free fall, the cap may slightly tilt, landing in an improper position on the container, failing to produce the desired thread alignment condition. Deep caps or caps with large threads, have inherent self-centering capability and accordingly, they can compensate, to a certain extent, for an imprecise positioning. However, shallow caps and caps with smaller thread sizes, have little ability to self-center themselves, in which case an improperly positioned cap will fail to produce a correct thread engagement during the cap tightening operation, resulting in a poorly sealed container.

OBJECTS AND STATEMENT OF THE INVENTION

An object of the present invention is an improved capping machine with provisions to guide a screw-type cap while the latter is being applied on the container to achieve an accurate cap positioning.

Another object of the invention is a capping machine as defined above, Which is relatively simple and inexpensive to produce.

In a broad aspect, the present invention provides an apparatus to cap in succession containers transported in serial order on a conveyance device, the apparatus comprising:

a cap dispensing station operating in a timed relationship With the containers movement to loosely apply on each container a screw-type cap in a thread alignment condition with threads on the container, the cap dispensing station including, a) a cap release passage at least partially closed by a resilient barrier preventing a cap to freely travel through the passage under the effect of gravity; and b) a selectively actuatable cap ejector driving the cap through the dropping passage against the resiliency of the barrier to free the cap and deposit same on a container underneath, the resilient barrier constituting means to guide the cap in its motion toward the container through a frictional sliding contact therewith in order to achieve the thread alignment condition;

a cap tightening station downstream of the cap dispensing station to rotatably grip the cap applied to the container, tightening same.

In a preferred embodiment, the cap dispensing station comprises a feed path to convey caps from a supply chamber to the cap release passage under the effect of gravity. The resilient barrier is a continuous annular lip projecting radially inwardly within the passage and circumferentially engaging a cylindrical cap travelling through the passage to achieve a smooth guiding action. Advantageously, the resilient lip is made of an abrasion resistant elastomeric material.

In a variant, a motor is provided in the cap dispensing station to impart a rotational movement to the cap while the cap is being deposited o the threaded neck of the container. The rotational movement of the cap further reduces the possibility of a thread misalignment condition to occur.

DESCRIPTION OF A PREFERRED EMBODIMENT

Figure 1:
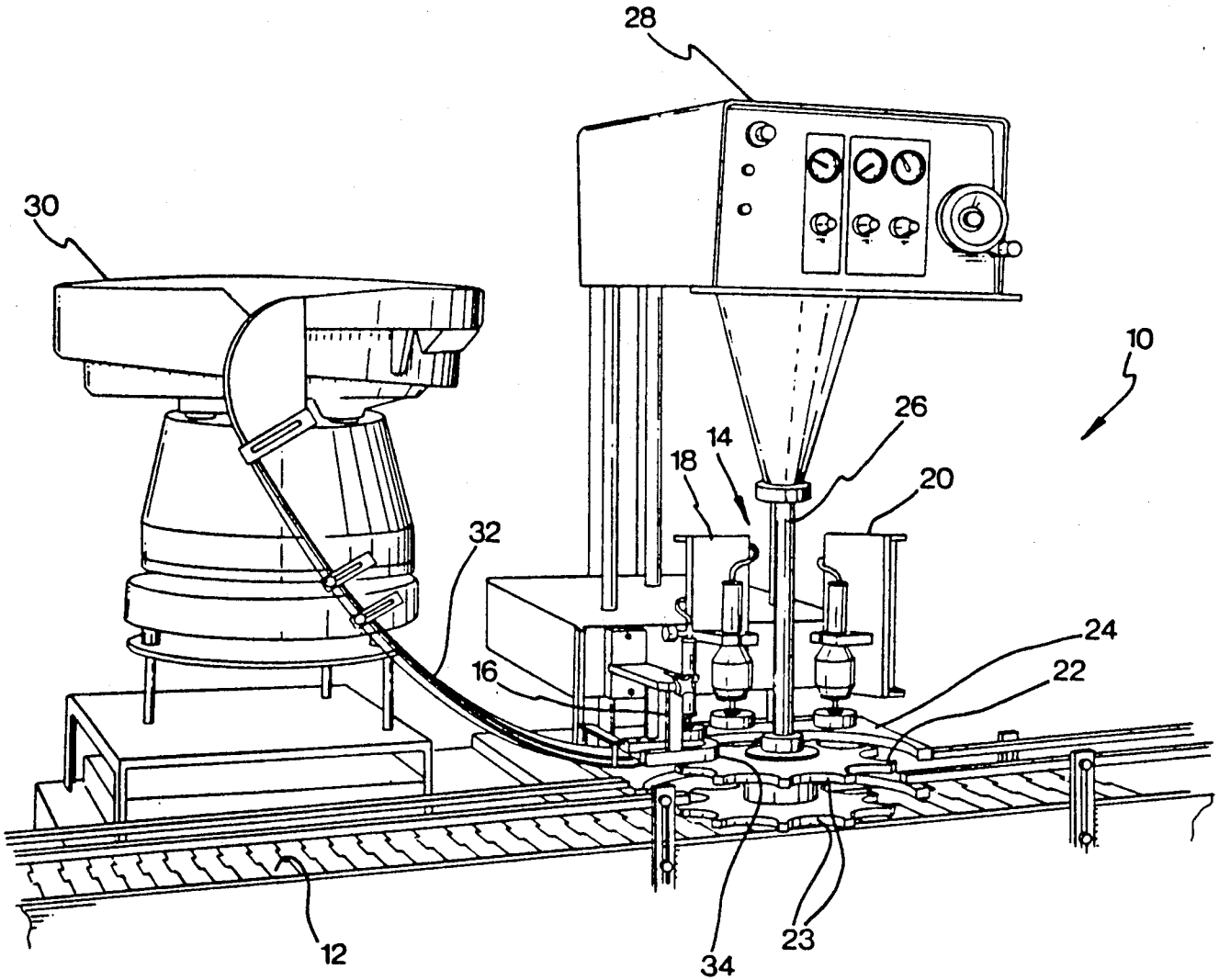
FIG. 1 is a perspective view of a capping machine constructed in accordance with the present invention.
Figure 2:
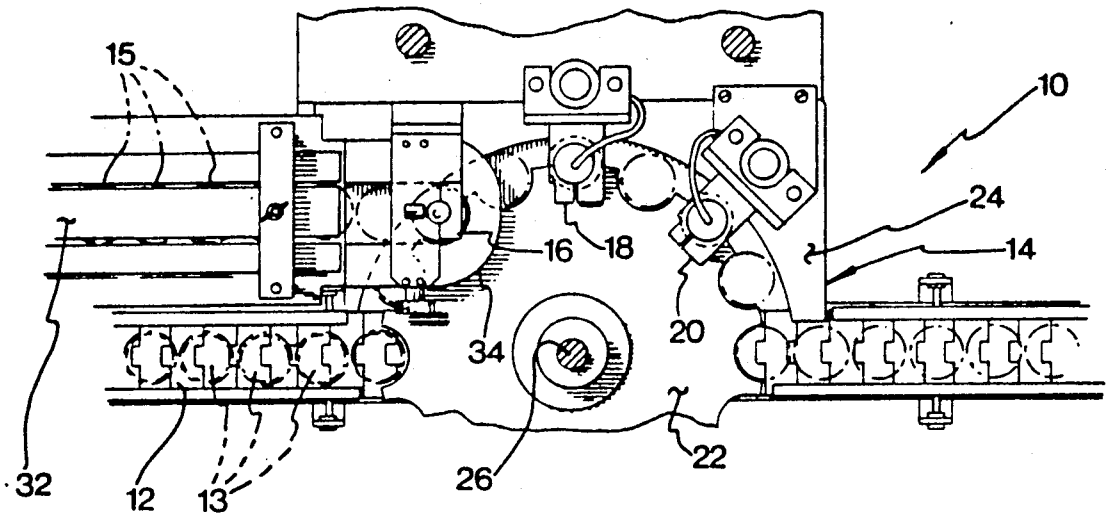
FIG. 2 is a top plan view of the machine, some elements being omitted for clarity.
Figure 3:
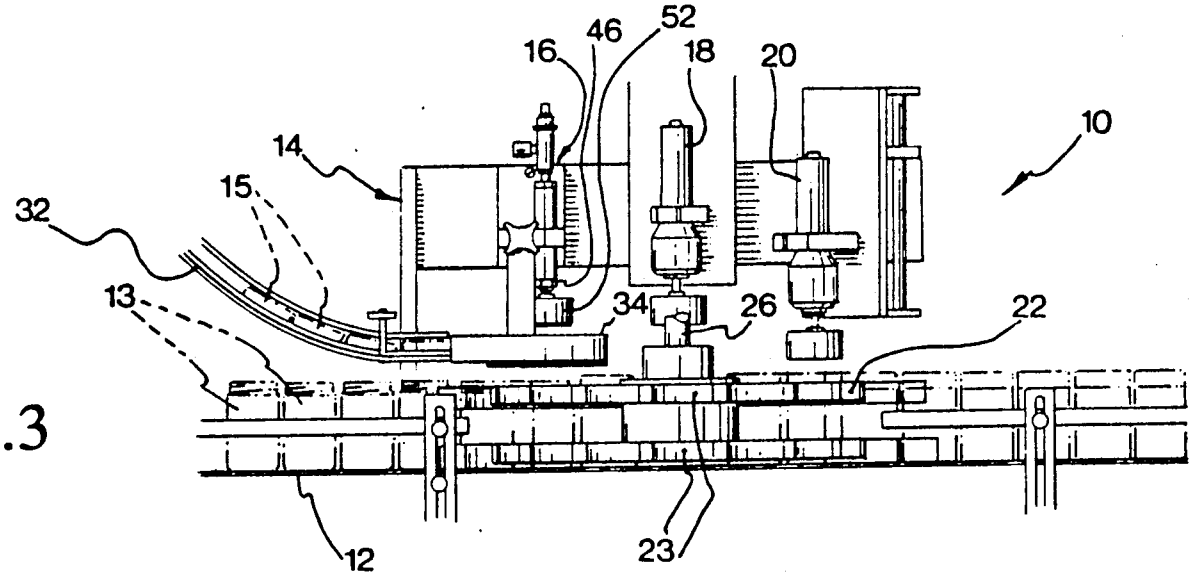
FIG. 3 is a side elevational view of the machine shown in FIG. 2.

With reference to FIGS. 1 to 3, a capping machine identified comprehensively by the reference numeral 10, comprises a conveyor belt 12 transporting in serial order containers 13 which are sealed at a capping assembly 14 and then returned to the conveyor belt 12 for further processing. The capping assembly 14 comprises a cap dispensing station 16 loosely applying a cap 15 on the threaded neck of a container 13, and cap-tightening stations !8 and 20 which pre-tighten and apply the final tightening torque to the caps 15, respectively.

The operation of the various stations of the capping assembly 14 is precisely synchronized with the feed-rate of the containers 13 through the machine 10. At this end, each container 13 is maintained captive during its passage through the various stations of the capping assembly 14 between a stepper wheel 22 rotating in short and essentially uniform angular movements and an arcuate guide rail 24. The stepper Wheel 22 advances each container !3 in discrete steps through the machine, precisely positioning the container 15 at the various processing stations. The stepper wheel 22 has a double sprocket-like configuration exhibiting a series of container holding recesses 23 whose shape is selected according to the configuration of the containers 13 to be capped. Power is transmitted to the stepper wheel 22 through a vertically extending shaft 26 from a motor (not-shown) housed in a top console 28 also regrouping the various controls of the machine 10.

Figure 4:
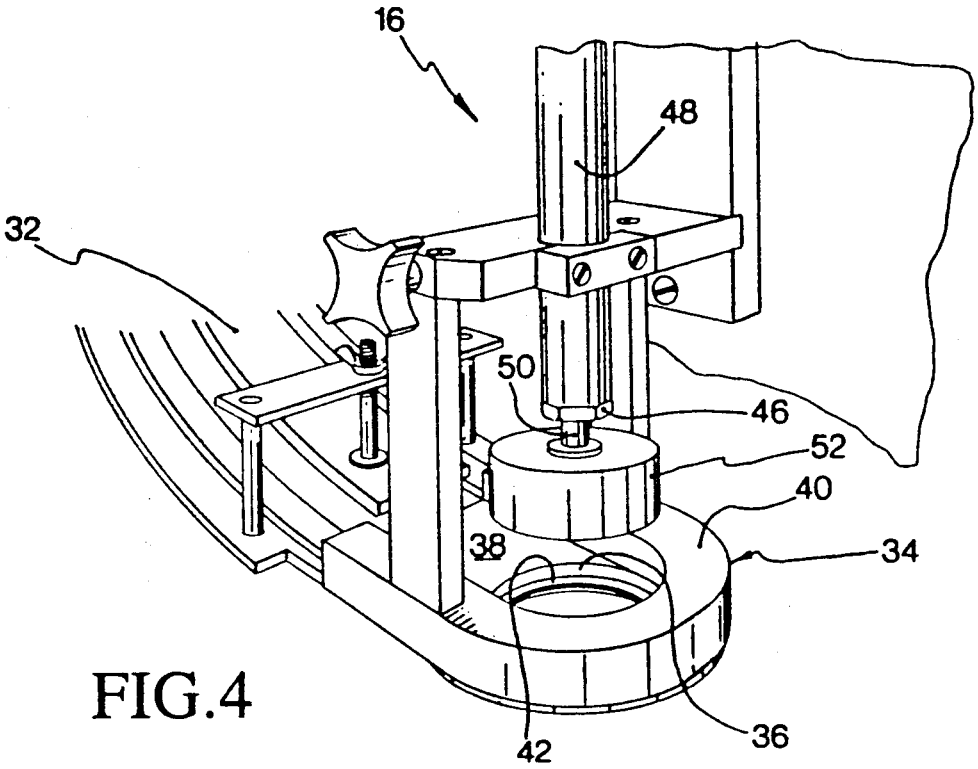
FIG. 4 is an enlarged perspective view of the cap dispensing station of the machine shown in FIGS. 1 to 3.
Figure 5:
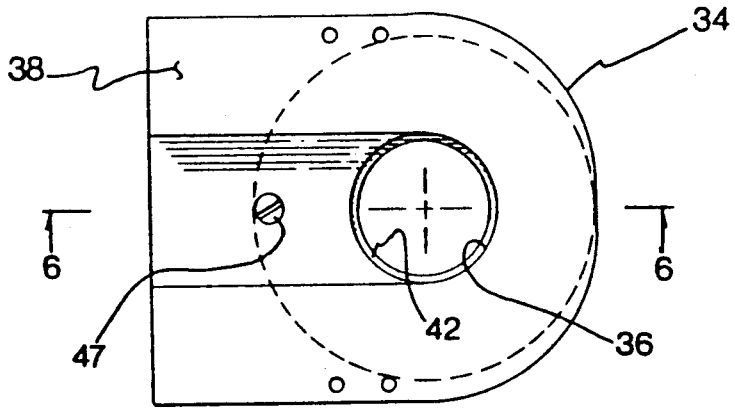
FIG. 5 is a further enlarged top plan view of the cap dispensing station shown in FIG. 4.
Figure 6:
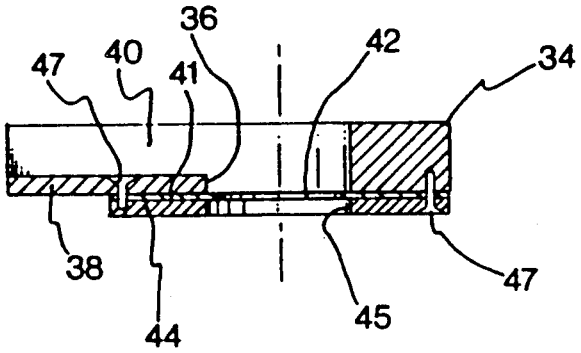
FIG. 6 is a cross-sectional view taken along line 6—6 in FIG. 5.

Screw-type caps 15 are supplied to the machine 10 from a supply chamber 30 Which is of a known construction. From the supply chamber 30, the caps 15 are conveyed to the cap-dispensing station !6 by sliding under the effect of gravity on a channel 32. As best shown in FIGS. 4, 5 and 6, the cap-dispensing station comprises a cap supporting pad 34 forming the terminal area of the channel 32, including an aperture 36 for releasing the caps 15 onto the containers 13 passing underneath. The supporting pad 34 comprises a bottom plate 38 which exhibits the aperture 36 and an upstanding U-shaped cap guide 40 whose central curved portion follows peripherally the aperture 36. On the bottom surface of the plate 38 is mounted an annular elastomeric abrasion resistant element 41 in register with the aperture 36. The diameter of the central opening of the annular elastomeric element 41 is smaller than the diameter of the aperture 36, Whereby forming a radially inwardly projecting continuous lip 42. The annular element 41 is retained against the plate 38 by a keeper ring 44 whose internal opening 45 is identical and registers with the aperture 36. The keeping ring 44 is retained to the plate 38 by machine screws 47. The aperture 36 and the opening 45 constitute a cap release passage constricted at mid-height by the annular elastomeric lip 42 which conditions the movement of the caps 15 through the release passage as it will be explained hereinafter.

A cap ejector assembly 46 is provided immediately above the aperture 36. The ejector assembly 46 comprises a pneumatic piston-cylinder assembly 4 Which includes a reciprocating piston (not shown in the drawings) connected to a piston rod 50 having a vertical axis of movement coinciding with the common centerline of the aperture 36 and the opening 45. On the free end of the piston rod 50 is mounted a cylindrical cap engaging block 52. The downward stroke of the piston in the piston cylinder assembly 48 is such that at full extension, the bottom surface of the cap engaging block 52 extends slightly beyond the horizontal level established by the lip 42 in an unstressed condition.

The operation of the capping machine 10 is as follows. Opened containers 13 Which have been previously filled with the desired material are transported in serial order on the conveyor belt 12. In the vicinity of the cappinq assembly 14, the containers 13 are deflected from their normal course by the stepper wheel 22 guiding and advancing the containers !3 through the various processing stations of the machine.

Figure 7:
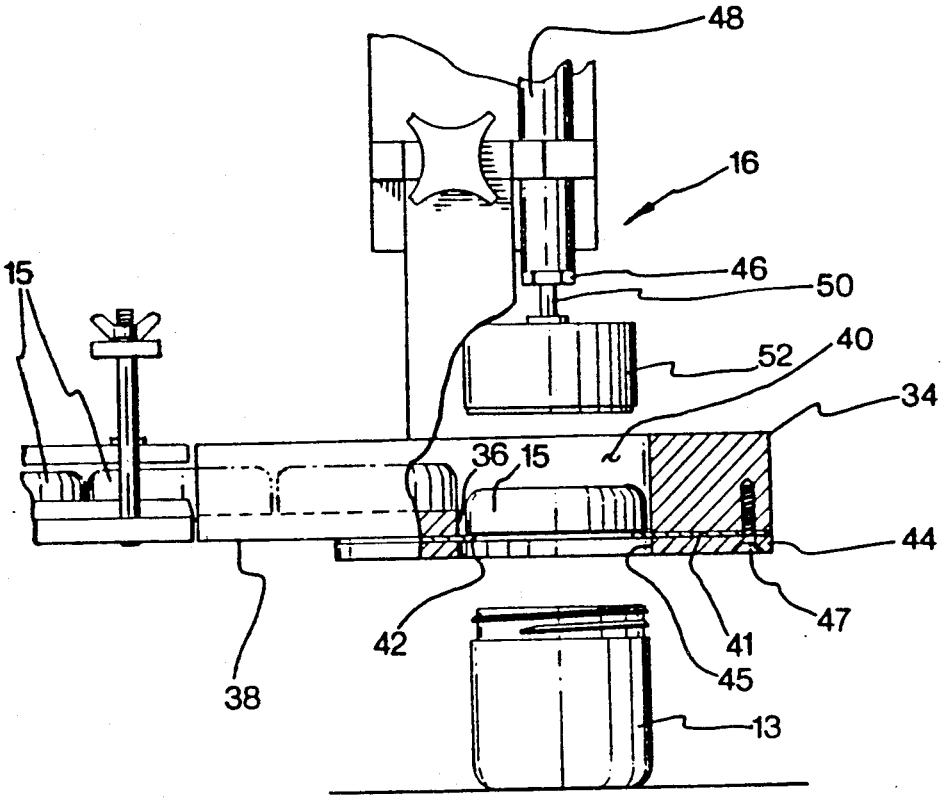
FIGS. 7 and 8 graphically depict the operation of the cap dispensing station.
Figure 8:
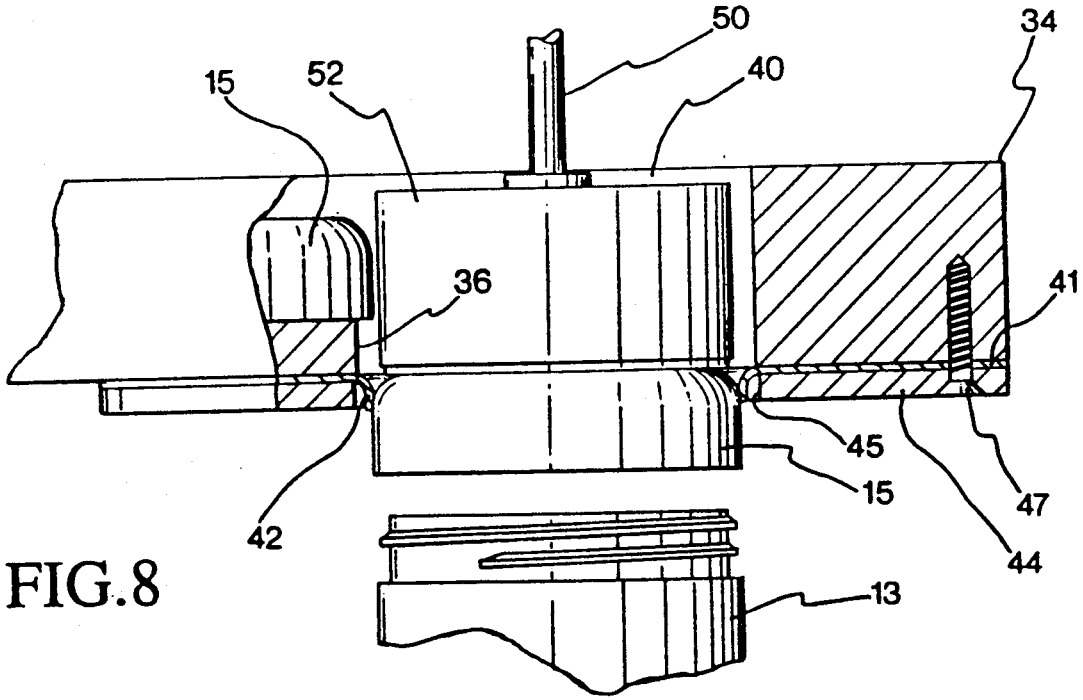

The stepper wheel 22 turning in uniform angular movements, brings a container 13 immediately below the cap dispensing station 16, the neck of the container being in register with the cap release passage defined by the aperture 36 and the opening 45. Screw-type caps 15, to be applied to the containers 13, are fed to the cap dispensing station 16 through the channel 32. The cap in the most advanced position on the channel 32, arriving on the pad 34, slides forwardly on the plate 38 and abuts against the curved portion of the U-shaped guide 40, which directs the cap within the aperture 36 while in the aperture 36, the cap sits on the resilient lip 42, as shown in FIG. 7, Which prevents the cap from dropping on the container 13 underneath. As now shown in FIG. 8, the ejector assembly 46 is actuated, extending the piston rod 50 and lowering the cap engaging block 52 which forces the cap 15 through the resilient lip 42, yielding sideways. During the downward motion of the cap, the resilient lip fictionally and slidingly engages the cap preventing it to move sideways or to tilt and effectively achieving a guiding function during most of the cap downward travel distance. The cap 15 is released from the resilient lip 42 only when it is deposited on the container neck. Accordingly, the cap is continuously guided by the resilient lip until firmly seated on the container, whereby reducing the risks of thread misalignment to occur. To achieve the desired synchronism between the cap release from the resilient lip 42 and the "touch-down" of the cap on the container neck, the distance between the top edge of the container neck and the resilient lip 42 must be equal to the cap height. Before each production run, the distance from container to resilient lip must be set according to the dimensions of the containers and cap to be processed.

It is also possible to reduce the container to resilient lip distance below the cap height dimension to somewhat ram the cap on the container neck. This embodiment is advantageous because it ensures a continuous guiding action by the resilient lip during the cap travel and allows to compensate for possible variations in the container or the cap dimensions which may otherwise cause a loss of synchronism in the cap release from the resilient lip 42 and a cap "touch-down" on the container.

It should be apparent that such cam ramming action must remain limited to prevent thread damage either to the cap or to the container.

To complete the cap dispensing cycle, the piston rod 50 is retracted clearing the aperture 36 and allowing a subsequent cap to enter and sit on the resilient lip 42 which by virtue of its elasticity has recovered to its unstressed horizontal position.

It will be appreciated that in addition to the cap guiding functions, the resilient lip 42 plays an additional role. It forms in combination with the ejector assembly 46 a latch system to control the cap release on the containers, which is extremely effective while remaining mechanically simple.

The structure of the supporting pad 34 will depend on the configuration of the cap which is to be dispensed. Due to the simplicity of this component, various pads 34 may be easily fabricated to suit different cap shapes and sizes so as to render the machine 10 versatile for use in applying screw-type caps of different kinds.

Simultaneously, with the retraction of the piston rod 50 at the completion of the cap dispensing cycle, the stepper wheel 22 is advanced to bring the container 13 in a position for engagement by the first tightening station 18 where the cap 15 is partially tightened. The wheel 22 is then revolved again to bring the container 13 to the second tightening station 20 Where the final tightening torque is applied to the cap 15. The structure and operation of the tightening stations 18 and 20 will not be further described because they are of a known construction.

Figure 9:
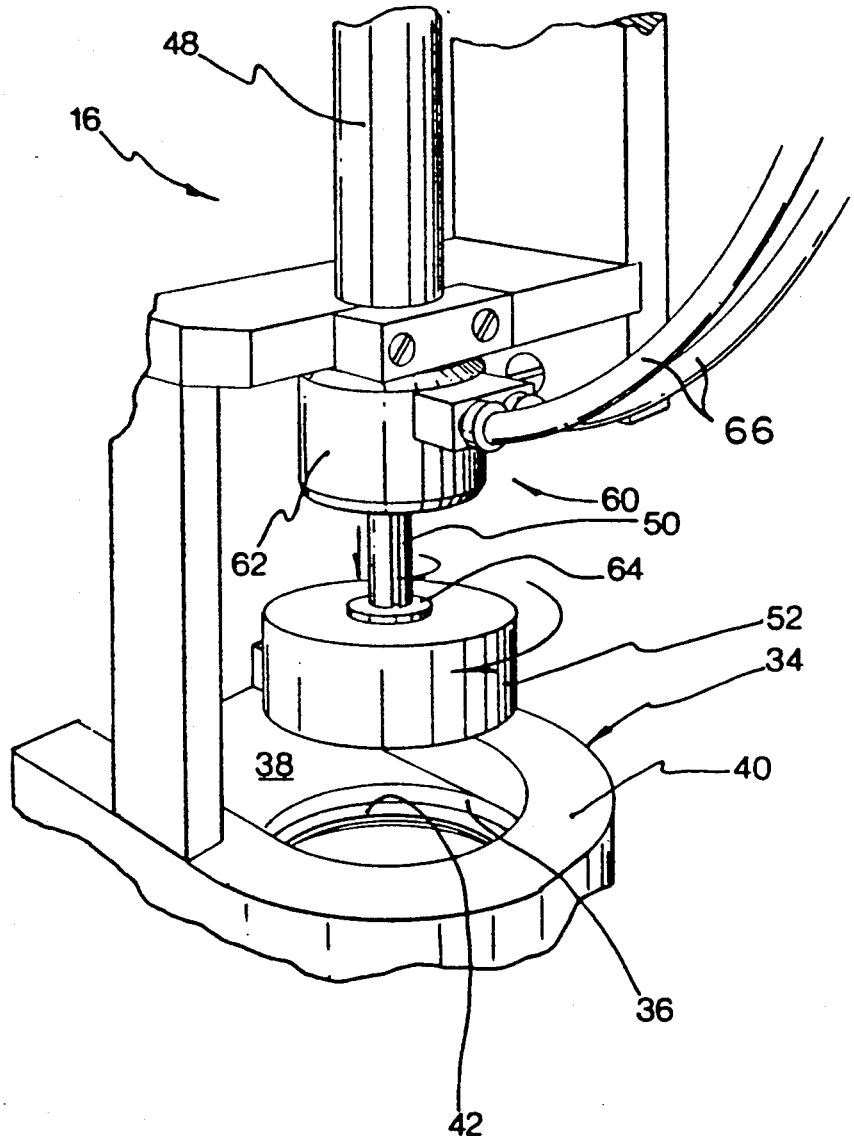
FIG. 9 is an enlarged perspective view of the cap dispensing station, according to a variant.

In a variant shown in FIG. 9, an air motor 60 is incorporated in the piston rod 50, comprising a stator 62 rigidly mounted to the piston rod 50, and a rotor 64 supporting the cap engaging block 52. Flexible compressed air supply lines 66 are connected to the motor 60 to supply thereto driving fluid at various vertical positions of the motor.

In operation, when the piston rod 50 is extended to eject a cap from the cap release passage, the cap engaging block 52 in frictional engagement with the cap 15 is not allowed to rotate because the cap is locked against rotation by the resilient lip 42, which causes the air motor 60 to slip. A rotational movement is imparted to the cap 15 only when both the cap and the cap engaging block 52 have cleared the resilient lip 42, which occurs when the cap is being deposited on the container neck. It has been observed that a rotational motion further reduces the possibility of thread misalignment and may in fact, at certain conditions, initiate the thread engagement. The direction of rotation of the cap, either in the tightening or the untightening direction, to achieve the best alignment action, is determined according to practical experimentation. For certain types of caps rotation in the tightening direction works best, while for other types of caps rotation in the untightening direction is better. Evidently, in the latter case, thread engagement cannot be initiated by the cap rotation.

The above description of a preferred embodiment of this invention should not be interpreted in any limiting manner as this embodiment may be refined and varied in various ways without departing from the spirit of the invention. The scope of the invention is defined in the annexed claims.

We claim:

1. An apparatus to cap in succession containers transported in serial order on a conveyance device, said apparatus comprising:

a cap dispensing station to loosely apply on each container a screw-type cap in a thread alignment condition with threads on the container, said cap dispensing station including:

a) a cap release passage;

b) a resilient barrier extending in said passage and at least partially closing said passage for preventing a cap to freely travel through said passage under the effect of gravity; and c) a selectively actuatable cap ejector driving the cap through said passage against the resiliency of said barrier to eject the cap and deposit same on a container underneath, said resilient barrier constituting means for guiding the cap in its motion toward the container through a frictional sliding contact therewith in order to achieve said thread alignment condition, a cap tightening station downstream of said cap dispensing station to rotatably grip the cap loosely applied to the container to tighten the cap.

2. An apparatus as defined in claim 1, wherein said cap dispensing station includes a cap supply chamber and a feed path to convey caps from said supply chamber toward said cap release passage.

3. An apparatus as defined in claim 2, wherein said feed path terminates with said cap release passage, further comprising a guide member adjacent said cap release passage, said guide member constituting means to direct a cap incoming on said feed path toward said cap release passage.

4. An apparatus as defined in claim 3, wherein said guide member is curved.

5. An apparatus as defined in claim 1, wherein said resilient barrier projects within said cap release passage to interfere with the passage of a cap therethrough

6. An apparatus as defined in claim 5, wherein said barrier is a continuous lip constricting said cap release passage.

7. An apparatus as defined in claim 6, wherein said barrier is made of abrasion resistant elastomeric material.

8. An apparatus as defined in claim 2, wherein said feed path comprises a channel downwardly inclined to feed caps to said cap release passage under the effect of gravity.

9. An apparatus as defined in claim 1, wherein said ejector comprises a reciprocating piston movable along an axis coinciding with a centerline of said cap release passage.

10. An apparatus as defined in claim 9, wherein said piston is pneumatically actuated.

11. An apparatus as defined in claim 1, further comprising a wheel advancing containers to be capped stepwise through said apparatus.

12. An apparatus as defined in claim 11, wherein said conveyance device is a conveyor belt.

13. An apparatus as defined in claim 1, wherein said resilient barrier releases a cap only when the cap is being supported on a container.

14. An apparatus as defined in claim 1, further comprising means to impart a rotational movement to the cap while depositing the cap on a container.

15. An apparatus as defined in claim 14, wherein said means to impart a rotational movement comprise a motor.

16. An apparatus as defined in claim 9, comprising motor means mounted to said ejector to impart a rotational movement to a cap deposited on a container.

17. An apparatus as defined in claim 1, wherein said resilient barrier has a generally circular configuration.

* * * * *